US005141235A

United States Patent [19]

Hernandez

[11] Patent Number: 5,141,235

[45] Date of Patent: Aug. 25, 1992

[54] EDUCATIONAL CARD GAME

[76] Inventor: Carlota B. Hernandez, 19072 Los Alimos, Northridge, Calif. 91326

[21] Appl. No.: 620,365

[22] Filed: Nov. 29, 1990

[51] Int. Cl.[5] ..... A63F 3/04; A63F 1/04

[52] U.S. Cl. ..... 273/308; 273/302; 273/157 R; 273/303; 434/129; 434/150

[58] Field of Search ..... 434/129, 130, 133, 150, 434/153; 273/302, 303, 304, 306, 307, 308, 236, 278, 276, 283, 157 R

[56] References Cited

U.S. PATENT DOCUMENTS

| | | | |
|---|---|---|---|
| 183,335 | 10/1876 | Sitterley | 434/130 X |
| 229,914 | 7/1880 | Read | 273/302 |
| 610,628 | 9/1898 | Jacobs | 434/150 |
| 631,766 | 8/1899 | Holman | 273/304 |
| 1,745,946 | 2/1930 | Murray | 434/130 X |
| 2,607,595 | 8/1952 | Mathes | 273/304 X |
| 3,347,550 | 10/1967 | Carboni | 434/150 X |
| 3,495,833 | 2/1970 | Wesley | 434/150 X |
| 3,935,651 | 2/1976 | Mankoff et al. | 434/167 X |
| 4,684,136 | 8/1987 | Turner | 434/327 X |
| 4,988,108 | 1/1991 | Shepard | 273/254 |
| 5,009,430 | 4/1991 | Yuhasz | 434/150 X |

FOREIGN PATENT DOCUMENTS

| | | | |
|---|---|---|---|
| 542045 | 4/1956 | Italy | 273/236 |

OTHER PUBLICATIONS

Catalog of International Learning Corporation, "Americard" and Eurocard, 1970.

*Primary Examiner*—Richard J. Apley
*Assistant Examiner*—Karen A. Richard
*Attorney, Agent, or Firm*—Lyon & Lyon

[57] ABSTRACT

An educational card game adapted to be played on a geographical game board bearing a continental area with countries marked and outlined therein. The outlined countries of the game board are geographically shaped and removed similar to puzzle pieces whereby each are adapted to fit with one another and to overlie the outlined country space. The game is played similar to gin rummy, whereby educational game cards with specific geographical features and information are used for the card playing aspect of the game. The players compete for desired cards, the accumulation of which entitles one player to win each round. The players, after each round is over, collect country board pieces which are added to a player's point totals. The game is completed when all of the country board pieces have been collected or a predetermined point total has been reached.

6 Claims, 2 Drawing Sheets

EDUCATIONAL CARD GAME

BACKGROUND OF THE INVENTION

1. Field of the Invention

The field of the invention relates to an educational game played with cards, and more particularly to such a game which features a map-like playing board pertaining to a geographical area.

2. Description of the Prior Art

Playing cards have been in existence, of course, for decades. During the course of their existence, and in addition to their role of providing entertainment, playing cards have served educational functions. Many card games which attempted to serve the dual roles of entertainment and education have compromised the entertainment element in order to promote and enhance the educational aspect. The present invention serves to entertain players at a psychologically consistent level, while at the same time teaching the players geography of a continent or a country as the game is played.

SUMMARY OF THE INVENTION

The present invention relates to card games and has for a principal object the provision of a game which will be a source of instruction as well as entertainment.

It is a further object of the present invention to provide an educational card game from which one may learn the countries of a specific continent, their capital cities, important lakes, rivers, mountains, and the principal characteristics (e.g., products or raw material's) for which the countries are noted. Also, a specific country, their states and capitals, and any specific geographical information can be learned from playing the game. It is an additional object to provide such a game that can be played by children or adults to enhance their knowledge of the world.

It is another object of the invention to provide a geographical card game in which the land areas of the continent or country are outlined or depressed in order to receive marked puzzle-like pieces in the shape of countries or states within the continental or country outline. The present invention seeks to entertain players while they are learning geography by utilizing playing cards, which are similar to regular playing cards but include a drawing of the continent and one specific country, which is located within the continent, depicted on the face side to aid the player in locating and acknowledging the country. The cards further have numbers (values) and suits, similar to regular playing cards. The game is played in a manner similar to gin rummy, making three or more of a kind and straights, but instead of having only numbers and suits on the cards, geographical features are also depicted. The first player to group all of the cards in "kinds" (e.g., three of a kind or three or more of the same value, similar to regular gin rummy) or "straights," is entitled to "go down" and claim the points associated with the cards, and to remove the corresponding piece of the puzzle from the game board.

Hence, the present invention seeks to improve the usefulness of card games by teaching geography during the course of play. Moreover, the card game seeks to improve upon the use of playing cards by themselves incorporating within the game a puzzle which depicts the continent or country about which the player wants to learn However, it is not necessary to incorporate a puzzle; a simple board with a map of the continent or country will do and could be played with tokens.

DETAILED DESCRIPTION OF THE PREFERRED EMBODIMENT

Figure 1:
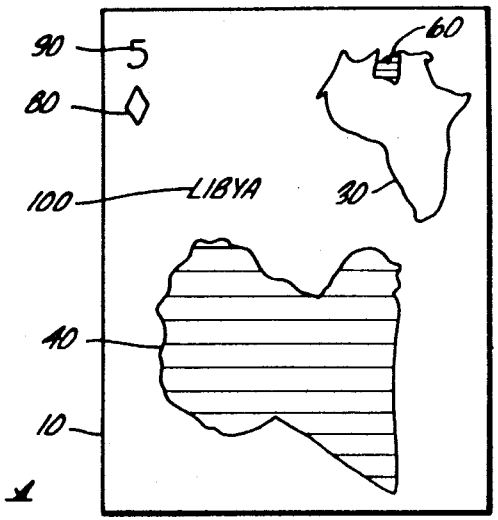
FIG. 1 is a collective perspective view of a small number of playing cards showing the outline of the continent depicted on the game board of FIG. 2, in the upper right hand corner, along with a country and its name depicted in the lower half of the card, with its relative location highlighted within the continent in the upper right hand corner.
Figure 2:
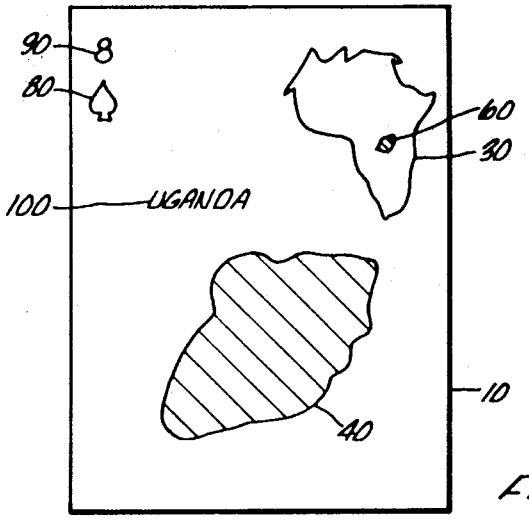
FIG. 2 is a pictorial view of the game board having the outline of a map of a continent (e.g., Africa) with its corresponding countries identified by their outlines therein.

Turning in detail to the drawings, FIG. 1 illustrates a group of game cards 10. FIG. 2 illustrates the game board 20, which serves dual roles as the base of a puzzle and as a geographic map. Imprinted on the game board 20 is an outline of the continent 30 which is divided into countries 40. Each country 40 can be independently separated from the game board 20 and from other countries 40, similar in fashion to pieces of a puzzle. In other embodiments, the game board 20 could be utilized as a single map of a continent or country whereby instead of picking up pieces from the puzzle, the game can be played with tokens. In such an alternative embodiment, the player will place a token on the game board according to the information contained in his or her game cards.

Turning again to FIG. 1, the continent 30 depicted on the game board 20 is also depicted on the game card 10 in its upper right hand corner. In the lower half of the game card 10 is illustrated a country 40, highlighted by inset 60 in the continent 30 depicted in the upper right hand corner of the game card. In the upper left hand corner is the value 90 of the game card 10 and the suit 80 (i.e., clubs, spades, etc.) associated with the game card 10. The names 100 of the countries 40 appear in the center of the game card 10.

The suits of the game cards are determined similar to regular playing cards, with suits of diamonds (♦), hearts (♥), spades (♠), and clubs (♣). There are 2 decks of 52 game cards each, thus there are 2 cards of each kind. The game cards are supplemented by 12 wild cards, whereby the wild cards are cards which solely contain an illustration of the continent 30 outlined in the game board 20. FIG. 2 also serves as a depiction of a wild card. The wild cards are utilized when a player needs a particular card to complete his or her hand.

The game cards correspond to pieces of the puzzle in the outlined area of the continent 30. The game board 20 illustrates and contains countries 40, and could also additionally contain capital cities, rivers, mountains, lakes and other geographical characteristics. When a player has all his cards arranged in three or more of a kind or straights, with one card he "goes down" by placing his cards by groups on the table or playing surface, and then throwing out the last remaining card. This player has won this round and is entitled to pick up the country pieces named on the game cards 10 from the game board 20. Some game cards 10 have further classified specific features of countries, which would be worth points themselves: for example, lakes, language, currency, capital, mountains, river, ocean, and sea.

OPERATION OF THE GAME

The dealer shuffles the deck of cards and the player on the right of the dealer cuts the deck. The dealer then deals eleven cards to each player, while the player on the right makes secondary individual piles of eleven cards for each player and puts them aside. These secondary piles will be each player's second hand. The remaining undealt cards are placed in a stack face down near the center of the table with the top card turned over and laid next to this stack. Approximately 2–6 people can participate in the game.

Each player should now begin setting up their cards in kinds or straights in relation to numbers or suits, respectively. The objective of each player is to arrange all cards in that player's hand into groups of three or more of a kind or straights of three of more cards in the same suit, with no stray cards remaining.

The first player to the left of the dealer begins play by either drawing a card from the face down pile or taking the one facing up. If the new card is advantageous to the player, the card may be kept and another card discarded into the "face up" pile. Once the first player discards into the pile, the next player draws and discards. This method of play continues throughout the course of the game. As play progresses, the discard stack (face up) will grow, and any player who wants to draw a card from that stack must take all cards which follow (i.e., are on top of) that particular card in the stack.

The first player to arrange all his cards in straights or kinds, with only one or no card left over "goes down" by placing his cards by groups on the table or playing surface. The player will then discard his stray card, if any, and pick up from the puzzle the piece or pieces corresponding to his game cards 10, thereafter continuing to play with his second "hand" (the group of secondary cards apportioned for use as a second hand at the time the cards were initially dealt). As the next player takes his turn, the player with the second "hand" of cards will proceed to set up his cards in straights and kinds and wait for his next turn to play. When his turn comes, he can pick up cards from the "discard" stack and add whatever cards he has to his groups on the table. He may also pick up from the puzzle any pieces he is able to win.

In order to win any subsequent round, a player must repeat the procedures of the first round by "going down" with his second hand of game cards. The first player "going down" on his second hand of game cards wins the round. However,in order to win, the player winning the round must have at least one group of his cards "closed," defined as those group of cards that number at least seven game cards. If a player runs out of cards to discard, he must continue to play discarding game cards from his groups on the table.

| | |
|---|---|
| All cards: | 10 points |
| Collected features, or each token place on the game board: | 20 points |
| Amount for "going down": | 100 points |
| For each group of "closed" cards with seven or more cards: | 100 points. |

After a player has won a round, all players must count the values of the game cards they have placed down as positive points, subtracting from this total, the values the cards that are remaining in their hands, as well as their respective eleven cards, set aside from their second "hand." Round after round is played until the first player to accumulate a predetermined number of points wins the game.

Points are also accumulated for countries earned.

This invention may also be applied in other embodiments relating to methods of obtaining knowledge in other fields, for example, archaeology, physical anatomy, and culture. One embodiment of the present invention is a game played without the puzzle; instead of utilizing the game board as a puzzle, the game board could be represented as a map having imprinted thereon the capital of countries or capitals of the states of a country, major cities, mountains, rivers, deserts, lakes, forests, points of interest, primary economic goods produced, mineral, raw mineral resources, etc. Such a game could be played with designated tokens in place of the puzzle. Additional education information can be represented on the game cards. For example, the birthplace, birthdate, native country, and identification of a historical figure associated with a specific country could be represented on the game cards. Other embodiments of the present invention may provide a more-detailed game board, representing an expanded version of the game. For example, an expanded game board could depict a continent and its surrounding hemisphere.

Hence, from all the foregoing, an educational card game played with game cards featuring geographical illustrations and information is disclosed which, in combination with a geographical, puzzle-like game board, provide a source of learning geography and entertainment. While embodiments and applications of this invention have been shown and described, it would be apparent to those skilled in the art that many modifications are possible without departing from the inventive concepts provided herein. The invention, therefore, is not to be limited or restricted except in the spirit of the appended claims.

What is claimed is:

1. An educational card game comprising a game board displaying a geographical outline, said geographical outline being depicted in the form of a continent with outlined areas representing countries geographically located within the continent and designated therein; and a plurality of playing cards comprising a plurality of decks of game cards, each deck of game cards including a plurality of different suits, each suit representing different countries identifiable on said game board.

2. The game card of claim 1 in which said outlined areas within the continent of said game board are a plurality of removable puzzle pieces, said puzzle pieces corresponding in number to the number of countries geographically located within the depicted continent, and said game board having means of fitting said puzzle pieces into said game board.

3. The card game of claim 1 in which said plurality of game cards further include wild cards having imprinted thereon an illustration of the game board.

4. A method of playing an education game with a map-like game board wherein said game board has a geographically outlined surface for supporting a plurality of geographically shaped jigsaw type game pieces, the enclosed portion of the geographically outlined surface of said game board having geographically outlined board pieces, said board pieces being removable from the game board and having indicia thereon indicating the location of the board piece on the game board. and game board indicia which identifies its respective position on the game board, said method comprising the steps of:

(a) a plurality of players at the beginning of a round of play being distributed a set of game cards;

(b) the players discarding strategically undesirable game cards and acquiring strategically desirable game cards, whereby each player attempts to construct a combination of game cards that will allow said player to win the round;

(c) the player winning the round forcing said round of play to terminate and points to be tallied, whereby the player winning the round or the player with the highest point total selecting said board pieces by removing the board pieces as indicated from the game board; and (d) said plurality of players following said steps of play until a predetermined number of points are obtained or until all game board pieces are removed from the game board.

5. The method as in claim 4 wherein said game cards have imprinted thereon on the face side of said game cards an illustration of the continental outline of said game board, said game card further having an illustration of one country geographically located in said continent outlined on said game board, said game card further having the country referenced geographically inside the illustration of the continental outline, said card further having a suit and value noted thereon, said method of discarding game cards further comprising the steps of:

(a) a player adding a game card by picking up a face down game card from a stacked pile of game cards;

(b) said player placing and displaying near the game board a numerical or predetermined combination of game cards extracted from the game cards in his possession; and (c) said player having the option of adding to the desired combination of game cards by placing additional combinations near the game board or returning the acquired game card or a substitute game card to a face up pile of game cards.

6. An educational card game comprising a game board displaying a geographical outline, said geographical outline being depicted in the form of a continent with outlined areas representing countries geographically located within the continent and designated therein;

a plurality of cards comprising a plurality of decks of game cards, each deck of game cards including a plurality of different suits, each suit representing different countries identifiable on said game board; and said game cards having imprinted on one side an illustration of the continental outline of said game board and an illustration of a country geographically located in said continent, said cards further having the country referenced geographically inside the illustration of the continental outline and a value and suit noted thereon.

* * * * *

UNITED STATES PATENT AND TRADEMARK OFFICE

CERTIFICATE OF CORRECTION

PATENT NO. : 5,141,235

DATED : August 25, 1992

INVENTOR(S) : Carlota B. Hernandez

It is certified that error appears in the above-identified patent and that said Letters Patent is hereby corrected as shown below:

| Column | Line | |
|---|---|---|
| 1 | 66 | before "incorporating", insert --by--. |
| 1 | 68 | after "learn" insert a period. |
| 2 | 5 | delete "collective perspective". |
| 2 | 5-6 | delete "small number of" and insert therefor --sample--. |
| 2 | 6 | delete "cards" and insert therefor --card from the diamonds suit,--. |
| 2 | 7 | delete "2," and insert therefor --5--. |
| 2 | 9 | after "name" insert --, in this case Libya,--. |
| 2 | 9 | delete "its" and insert therefor --the country's--. |
| 2 | 10 | delete "continent" and insert therefor --outline of the continent--. |

UNITED STATES PATENT AND TRADEMARK OFFICE

CERTIFICATE OF CORRECTION

PATENT NO. : 5,141,235

DATED : August 25, 1992

INVENTOR(S) : Carlota B. Hernandez

Figure 3:
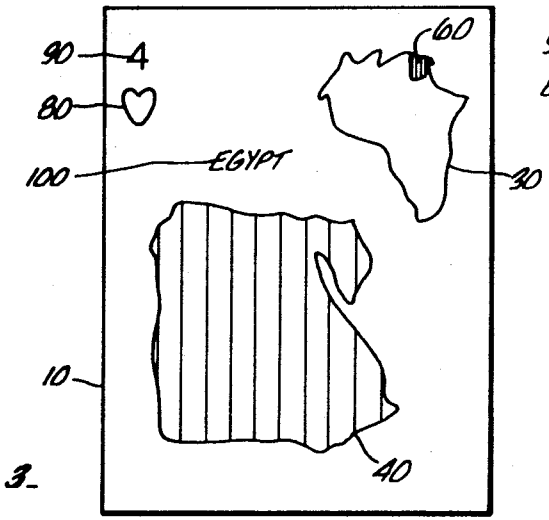
Figure 5:
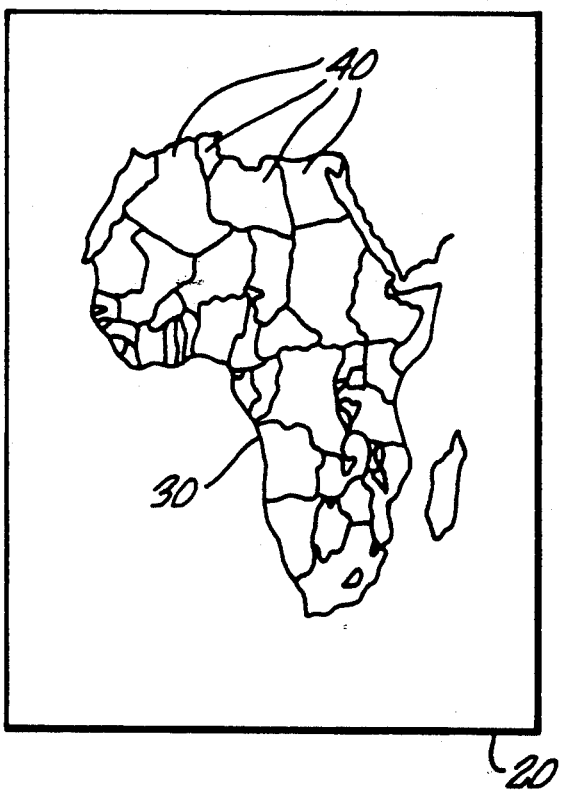

It is certified that error appears in the above-identified patent and that said Letters Patent is hereby corrected as shown below:

| Column | Line | |
|---|---|---|
| 2 | between 11 and 12 | insert --Fig. 2 is a view of a sample playing card from the spades suit, showing the outline of the continent depicted on the game board of Fig. 5 in the upper right hand corner, along with a country and its name, in this case Uganda, depicted in the lower half of the card, with the country's relative location highlighted within the outline of the continent in the upper right hand corner.<br><br>Fig. 3 is a view of a sample playing card from the hearts suit, showing the outline of the continent depicted on the game board of Fig. 5 in the upper right hand corner, along with a country and its name, in this case Egypt, depicted in the lower half of the card, with the country's relative location highlighted within the outline of the continent in the upper right hand corner. |

UNITED STATES PATENT AND TRADEMARK OFFICE

CERTIFICATE OF CORRECTION

PATENT NO. : 5,141,235

DATED : August 25, 1992

INVENTOR(S) : Carlota B. Hernandez

Figure 4:
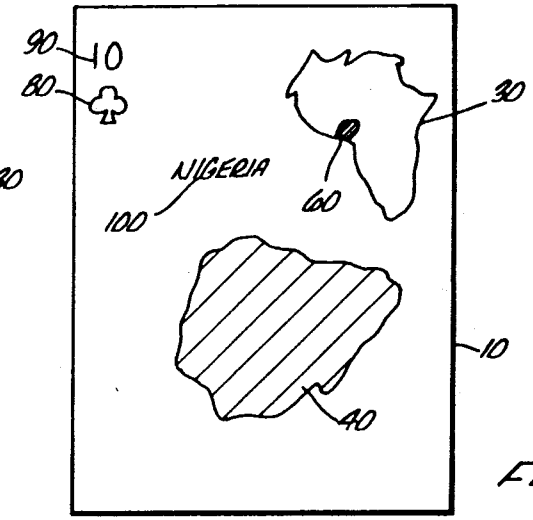

It is certified that error appears in the above-identified patent and that said Letters Patent is hereby corrected as shown below:

| Column | Line | |
|---|---|---|
| 2 | between 11 and 12 (cont'd) | Fig. 4 is a view of a sample playing card from the clubs suit, showing the outline of the continent depicted on the game board of Fig. 5 in the upper right hand corner, along with a country and its name, in this case Nigeria, depicted in the lower half of the card, with the country's relative location highlighted within the outline of the continent in the upper right hand corner.-- |
| 2 | 12 | delete "2" and insert therefor --5--. |
| 2 | 19-20 | delete "Fig. 1 illustrates a group of" and insert therefor --Figs. 1-4 illustrate sample--. |
| 2 | 20 | delete "Fig. 2" and insert therefor --Fig. 5--. |
| 2 | 34 | delete "again to" and insert therefor --to the sample game card depicted in--. |

UNITED STATES PATENT AND TRADEMARK OFFICE

CERTIFICATE OF CORRECTION

PATENT NO. : 5,141,235

DATED : August 25, 1992

INVENTOR(S) : Carlota B. Hernandez

It is certified that error appears in the above-identified patent and that said Letters Patent is hereby corrected as shown below:

| Column | Line | |
|---|---|---|
| 2 | 51 | delete "Fig. 2" and insert therefor --Fig. 5--. |
| 3 | 17 | delete "three of" and insert therefor --three or--. |

Signed and Sealed this

Eleventh Day of October, 1994

*Attest:*

*Attesting Officer*

Bruce Lehman

BRUCE LEHMAN

*Commissioner of Patents and Trademarks*